US007260905B1

(12) United States Patent
Chen

(10) Patent No.: US 7,260,905 B1
(45) Date of Patent: Aug. 28, 2007

(54) AUTOMATIC SPINNING DEVICE FOR DISPLAYING OBJECT

(76) Inventor: Tsan-Yao Chen, 2-1 Fl., No. 76, Sec. 3, Hsinsheng North Rd., Taipei City (TW)

( * ) Notice: Subject to any disclaimer, the term of this patent is extended or adjusted under 35 U.S.C. 154(b) by 0 days.

(21) Appl. No.: 11/621,582

(22) Filed: Jan. 10, 2007

(51) Int. Cl.
*G09F 19/00* (2006.01)

(52) U.S. Cl. ..... 40/426; 40/406

(58) Field of Classification Search ..... 40/426, 40/406, 409, 414, 430, 455; 446/267, 133
See application file for complete search history.

(56) References Cited

U.S. PATENT DOCUMENTS 4,757,986 A * 7/1988 Hwang et al. ..... 472/6
4,852,283 A * 8/1989 Teng ..... 40/426
5,435,086 A * 7/1995 Huang ..... 40/426
6,132,284 A * 10/2000 Lin ..... 446/267
6,357,151 B1 * 3/2002 Yuen ..... 40/406
6,415,535 B1 * 7/2002 White et al. ..... 40/410
6,508,022 B2 * 1/2003 Huang ..... 40/426
6,568,107 B2 * 5/2003 Yuen ..... 40/406
6,588,130 B1 * 7/2003 Yang ..... 40/410
6,814,646 B2 * 11/2004 Atobe et al. ..... 446/267
6,848,206 B2 * 2/2005 Zhao ..... 40/406
6,978,564 B2 * 12/2005 Hou ..... 40/406

* cited by examiner

*Primary Examiner*—William L. Miller
(74) *Attorney, Agent, or Firm*—Leong C. Lei

(57) ABSTRACT

An automatic spinning device for displaying objects which utilizes a novel winding-up mechanical is provided herein. The major characteristic of the winding-up mechanism lies in the use of magnetism to wind up the winding-up mechanism housed in an airtight space. Two concentric rings are arranged along the circumferential wall of the airtight space, with one outside the space and the other one inside the space. The two rings are equipped with magnets of opposite polarities so that, when the external one is turned, the internal one is turned automatically by the magnetic attraction force. The inner ring has gear teeth along its inner wall, which engages a gear assembly to wind up the winding-up mechanism of the device as the inner ring is turned along with the external ring.

4 Claims, 5 Drawing Sheets

AUTOMATIC SPINNING DEVICE FOR DISPLAYING OBJECT

TECHNICAL FIELD OF THE INVENTION

The present invention generally relates to devices for displaying objects, and more particularly to a device which automatically spins the displayed object by a winding-up mechanism.

DESCRIPTION OF THE PRIOR ART

Winding-up mechanism has been widely used on clockworks, toys, music boxes, etc. for a long time. The basic operation principle of the winding-up mechanism is to store energy (for example, by winding and tightening an internal spring) and then to release the energy (for example, by letting the spring to unwind) in a prolonged period of time.

Conventionally, a winding-up mechanism is difficult to be sealed in an airtight space as, for example, the knob for tightening and winding the spring has to be exposed for access. This has somewhat limited the applicability of the winding-up mechanism in some applications, especially when the winding-up mechanism has to be close to or immersed in liquid.

SUMMARY OF THE INVENTION

The primary purpose of the present invention is to provide an automatic spinning device for displaying an object which utilizes a novel winding-up mechanism is provided herein.

The winding-up mechanism's energy storing and releasing means are basically identical to those of the prior arts. The major characteristic of the winding-up mechanism, however, lies in the use of magnetism to wind up the winding-up mechanism housed in an airtight space.

According to the present invention, two concentric rings are arranged along the circumferential wall of the airtight space, with one outside the space and the other one inside the space. The two rings are equipped with magnets of opposite polarities so that, when the external one is turned, the internal one is turned automatically by the magnetic attraction force. The inner ring has gear teeth along its inner wall, which engages a gear assembly to wind up the winding-up mechanism of the device as the inner ring is turned along with the external ring.

The foregoing object and summery provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
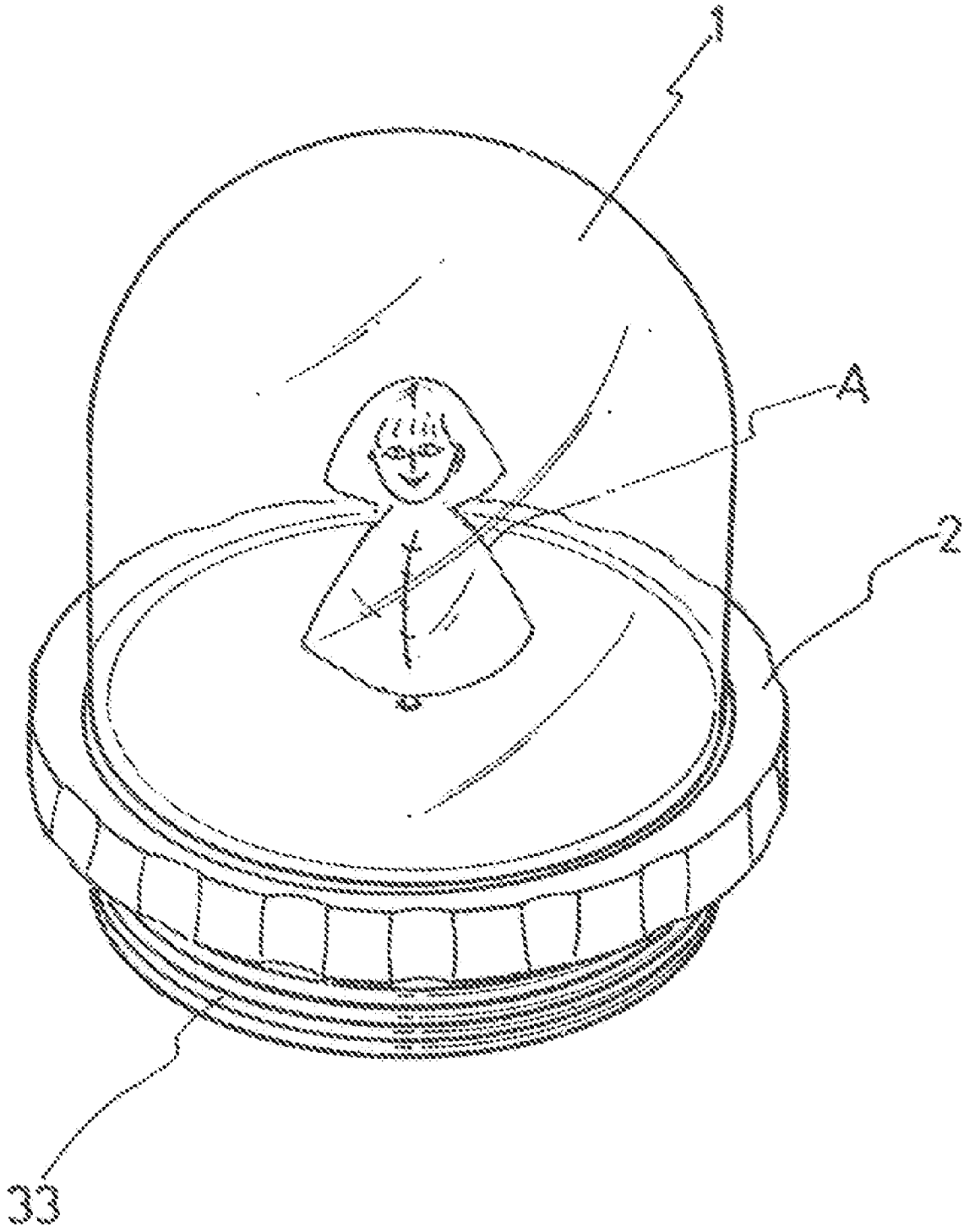
FIG. 1 is a perspective diagram showing an automatic spinning device according to an embodiment of the present invention after it is assembled.
Figure 2:
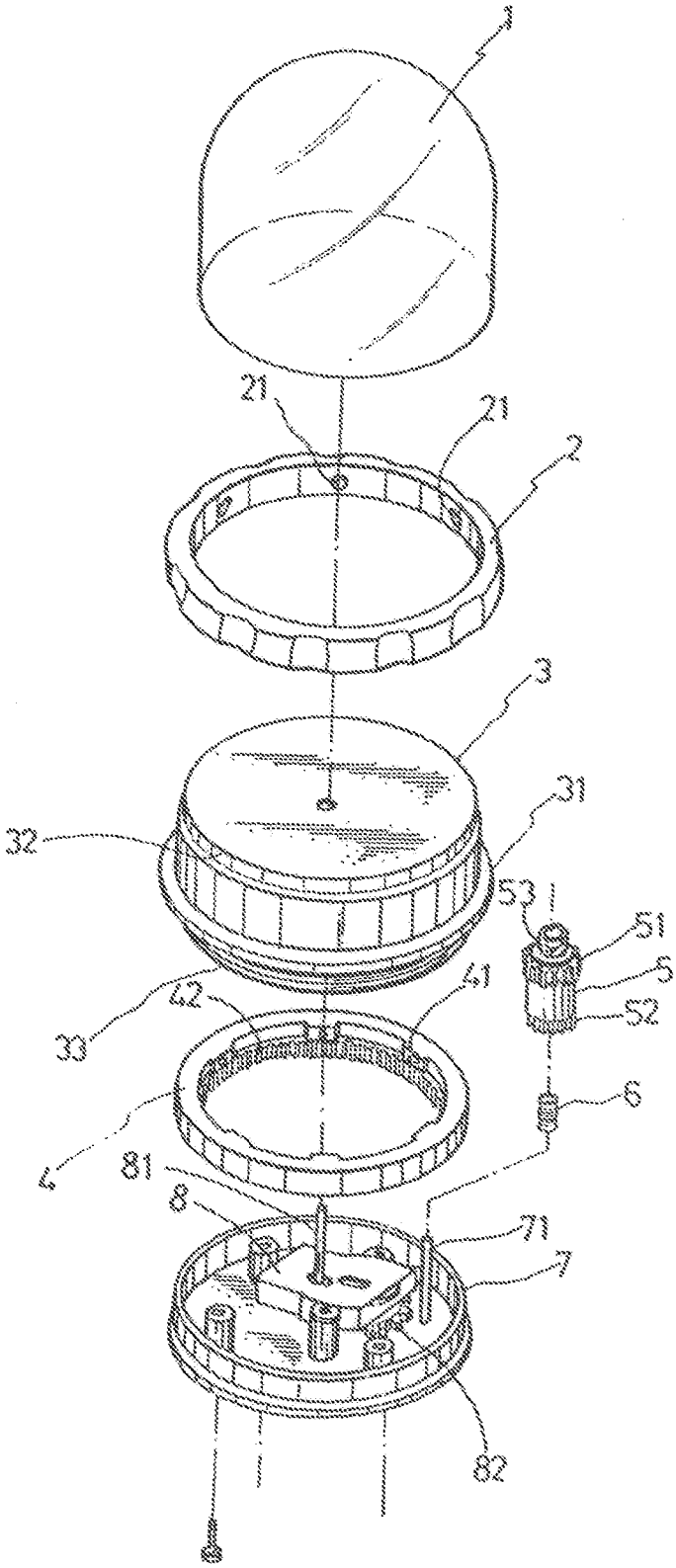
FIG. 2 is a perspective exploded diagram showing the various components of the automatic spinning device of FIG. 1.
Figure 3:
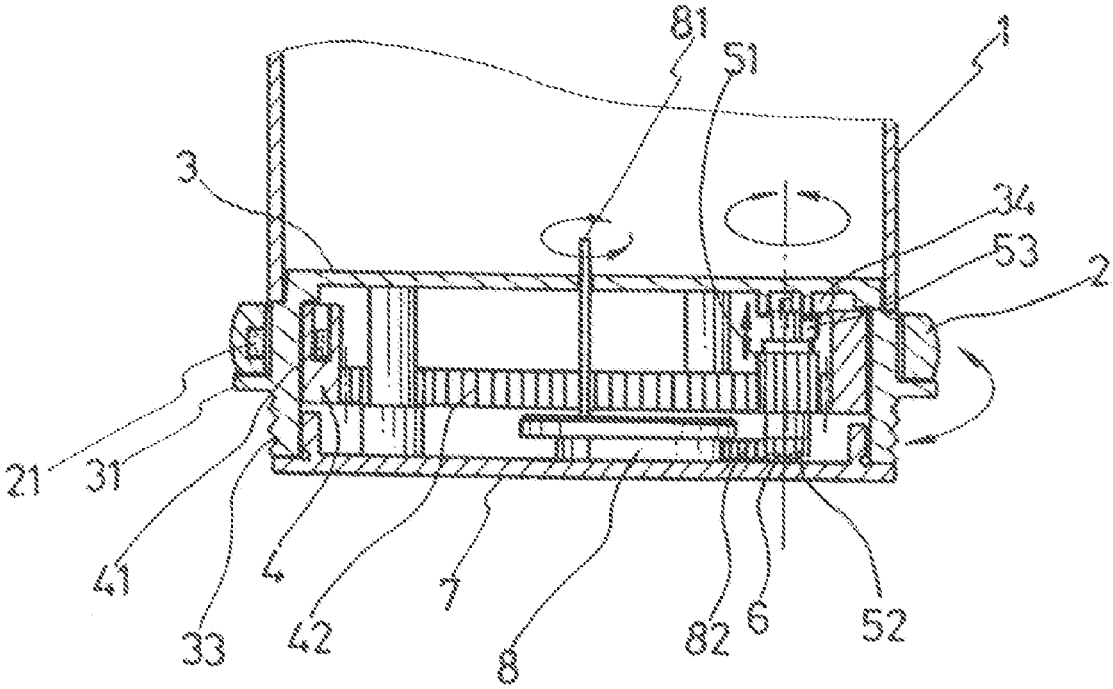
FIG. 3 is a partial sectional digram showing the base of the automatic spinning device of FIG. 1.
Figure 4:
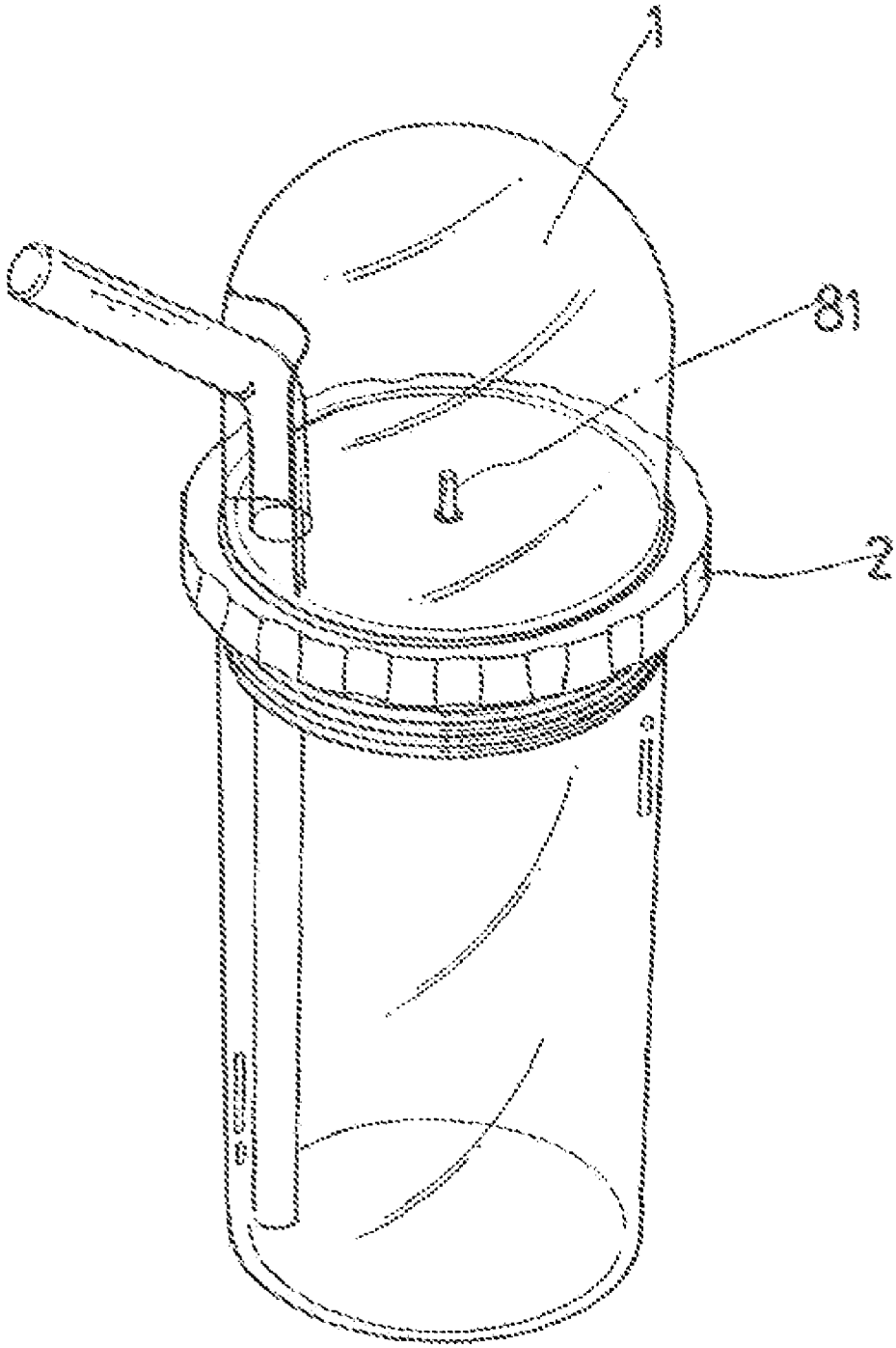
FIG. 4 is a perspective diagram showing an application scenario of the automatic spinning device of FIG. 1.
Figure 5:
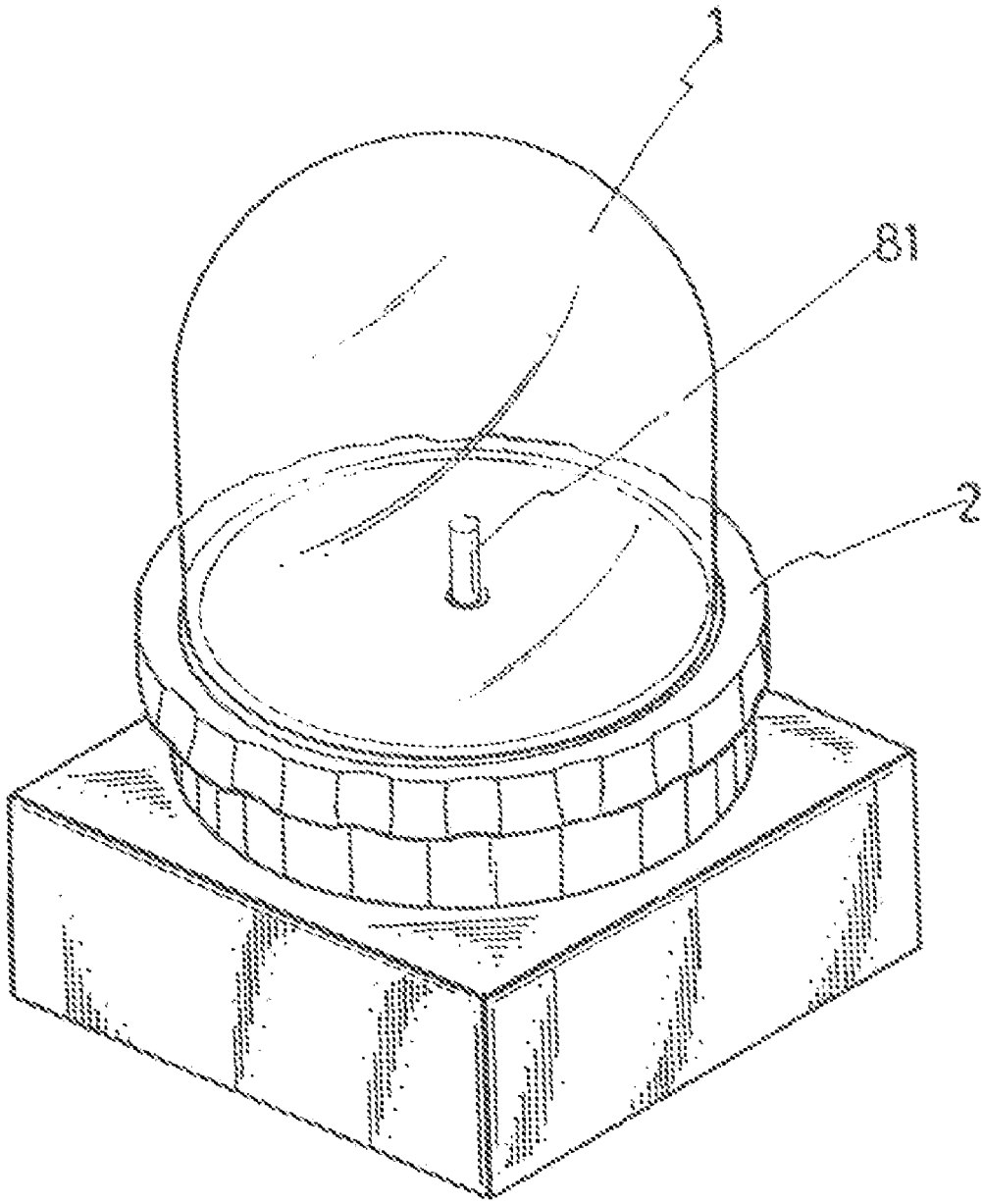
FIG. 5 is a perspective diagram showing another application scenario of the automatic spinning device of FIG. 1.

As shown in FIGS. 1 and 2, an automatic spinning device contains a transparent dome lens 1, a first ring 2, and a hollow cylindrical base formed by joining an inversed cup-like top member 3 and a bottom member 7. Around the circumference of the top member 3, a first flange 31 and a second flange 32 are provided. The first flange 31 on which the first ring 2 rests is located below the second flange 32 on which the dome lens 1 rests. Please note that the first ring 2 is not fixedly attached to but is rotatable around the top member 3. The dome lens 1 can be fixedly attached to the top member 3 so as to form an airtight space to completely seal a displayed object (A) inside for protection. If required, the airtight space can also be filled with water or other type of liquid. Also around the circumference of the top member 3 and beneath the first flange 31, a number of threads 33 are provided such that the base and the automatic spinning device can be fixed on top of a cup (as shown in FIG. 4) or a seat (as shown in FIG. 5).

The top member 3 and the bottom member 7 are screwed together or fixedly joined together by similar means. A second ring 4 is placed inside the hollow space created by the top and bottom members 3 and 7. The second ring 4 is configured such that its circumference matches the wall surrounding the hollow space. In addition, the second ring 4 is raised by the bottom member 7 to substantially the same height as the first ring 2. Around the inner wall of the first rig 2, a number of magnets 21 are positioned at equal spacing. Correspondingly, a number of magnets 41 of opposite polarity to the magnets 21 are positioned along the circumference, also at equal spacing, of the second ring 4. Due to the magnetic attraction between the magnets 21 and 41, the second ring 4 will spin along with the first ring 2 as the latter is turned.

The inner all of the second ring 4 is completely configured with gear teeth 42, which engage an active gear 5 mounted on a first shaft 71 erected vertically from the bottom of the bottom member 7. The active gear 5 actually has upper teeth 51 and lower teeth 52 around its circumference. The upper teeth 52 engage with the gear teeth 42 while the lower teeth engage with a passive gear 82 of a winding-up member 8 also housed inside the hollow space. As described earlier, the second ring 4 is rotated along with the first ring 2. In the mean time, the active gear 5 drives the passive gear 82, which in turn winds up the winding-up member 8. The details of the winding-up member 8 such as its spring are not shown in the diagrams for simplicity, as this should be well known to people or related arts. Due to the structure described above, turning the first ring 2 is like winding up. The winding-up member 8 has a second shaft 81 erected vertically through the top surface of the top member 3 and into the space of the dome lens 1. The display object (A) is mounted on the end of the second shaft 81 so that, when the first ring 2 is not turned and subsequently during the time the winding-up member 8 gradually released the energy stored in its spring, the second shaft 81 along with the display object (A) are automatically rotated.

Please note that, along the first shaft 71, the active gear 5 is positioned on top of a resilient element (such as a helix spring) 6. Normally, the spring 6 would lift the active gear 5 so that the lower teeth 52 will not engage the passive gear 82. Therefore, an reciprocal mechanism is provided, which contains a first reciprocal element 53 on top of the active gear 5 and a second reciprocal element 34 extended from the ceiling of the top member 3. Due to the interaction of the two elements 53 and 34, the active gear 5 is put into a reciprocal movement along the first shaft 71 when the active gear 5 is turned by the second ring 4. For every turn of the active gear 5, the active gear 5 is first lowered down to engage the passive gear 82 to wind up the winding-up member 8, and then the active gear 5 is lifted to disengage the passive gear 82. As such, the energy stored in the winding-up member 8 will not be fed back to the active gear 5 and in turn the rings 2 and 4.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the form and details of the device illustrated and in its operation can be made by those skilled in the art without departing in any way from the spirit of the present invention.

I claim:

1. An automatic spinning device, comprising:

a base having an inversed cup-like top member and a bottom member joined together and thereby forming a first space therewithin, said top member having a first flange and a second flange above said first flange around the circumference of said top member;

a transparent lens positioned on top of said second flange and thereby forming a second space between said transparent lens and said top member;

a first ring rotatably and horizontally positioned on top of said first flange, said first ring having a plurality of magnets positioned at equal spacing along the inner wall of said first ring;

a second ring rotatably and horizontally positioned inside said first space at substantially the same height as said first ring, said second ring having a plurality of magnets positioned at equal spacing along the circumference of said second ring correspondingly to said magnets of said first ring, respectively, said magnets of said first ring having opposite polarity to that of said magnets of said second ring; said second ring having gear teeth configured along the inner wall of said second ring;

a winding-up member having a second shaft erected vertically through said top member and into said second space; and an active gear mounted on a first shaft erected vertically from the bottom of said bottom member inside said first space, said active gear having upper teeth and lower teeth around the circumference, said upper teeth engaging said gear teeth of said second ring, said lower teeth engaging a passive gear which in turn winds up said winding-up member;

wherein, when said first ring is turned, said second ring is turned as well due to magnetic attraction from said first ring; said second ring in turn drives said active and passive gears to wind up said winding-up member.

2. The automatic spinning device according to claim 1, wherein a reciprocal mechanism is provided between said active gear and said top member such that, for each turn of said active gear, said active gear completes reciprocal movement along said first shaft.

3. The automatic spinning device according to claim 1, wherein said second space is filled with liquid.

4. The automatic spinning device according to claim 1, wherein an object for display is mounted on the end of said second shaft of said winding-up member inside said second space.

* * * * *